United States Patent [19]

Sicard

[11] 3,995,076

[45] Nov. 30, 1976

[54] PROGRESSIVE FELTING OF FILTER ELEMENTS

[75] Inventor: Marcel Clarence Sicard, Cheshire, Conn.

[73] Assignee: AMF Incorporated, White Plains, N.Y.

[22] Filed: May 19, 1975

[21] Appl. No.: 578,442

[52] U.S. Cl. ..... 427/295; 210/496; 210/505; 264/165

[51] Int. Cl.[2] ..... B29J 1/02

[58] Field of Search ..... 210/496, 505; 264/87, 264/165; 162/228, 230, 388; 427/180, 295

[56] References Cited

UNITED STATES PATENTS

| | | | |
|---|---|---|---|
| 2,539,767 | 1/1951 | Anderson | 162/228 X |
| 2,539,768 | 1/1951 | Anderson | 210/496 |
| 2,700,326 | 1/1955 | Curtis | 210/496 X |
| 3,619,353 | 11/1971 | Williams | 162/228 X |
| 3,793,138 | 2/1974 | Rohrer | 162/228 X |

*Primary Examiner*—Frank W. Lutter
*Assistant Examiner*—William Cuchlinski, Jr.
*Attorney, Agent, or Firm*—George W. Price; Martin Smolowitz

[57] ABSTRACT

A method for progressively vacuum forming a fibre batt about a porous member whereby, accretion, consolidation and dewatering of the batt occurs under constant vacuum conditions and includes continuously introducing a vacuum through a fixed porous arbor disposed in a tank containing a slurry of fibrous material in water, to thereby define a fixed vacuum zone between sealed first and second portions of the arbor, for the progressive formation of a fibrous batt in the vacuum zone, and continuously advancing the arbor through the vacuum zone at a preselected constant rate of travel.

1 Claim, 4 Drawing Figures

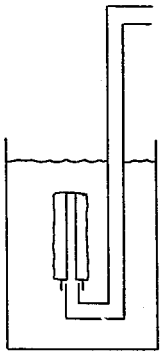
FIG. 1a
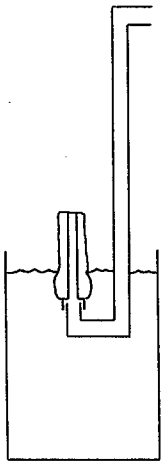
FIG. 1b
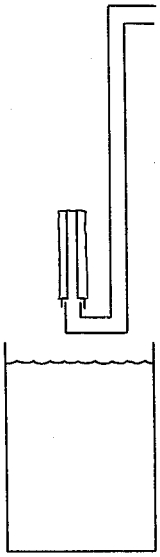
FIG. 1c
FIG. 2
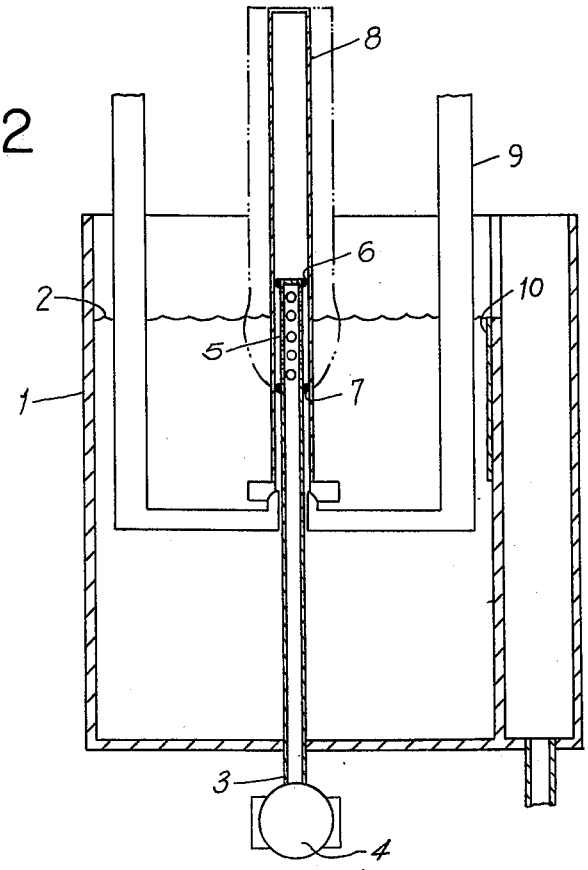

PROGRESSIVE FELTING OF FILTER ELEMENTS

The present invention is directed to a method of manufacturing a rigid, self-supporting, porous tubular filter element comprised of resin bonded fibrous material. The prior art manufacture of such filter elements has closely followed the process disclosed in U.S. Pat. No. 2,539,768 (Anderson) with only one significant variation; that is, the fibrous structure is vacuum accreted out of an aqueous dispersion of fibres, dried, and then subsequently impregnated with an aqueous dispersion of resin.

In accordance with the prior art, a typical manufacturing operation would utilize one or more porous felting arbors connected to a vacuum source through a separator which serves to prevent water carry-over to the vacuum source. In the first stage of the manufacturing operation, the porous felting arbor is immersed, and held in a static position, in the aqueous fibre dispersion, otherwise known as a slurry. Energization of the vacuum source causes the slurry to be drawn through the porous felting arbor, and the straining of the fibres out of the slurry results in the accretion of such fibres on the porous arbor. This process of accretion is known as felting and the accreted structure is known as a batt. The porous felting arbor is held statically immersed in the slurry until sufficient felting has taken place to form a batt of required diameter and wall thickness. As soon as an adequate batt has been formed, the arbor and batt are withdrawn from the slurry. As the batt exits the surface of the slurry, the action of the vacuum source causes water to be removed from the batt and, lastly, air is drawn through the batt. Finally, the arbor and batt are statically held in the withdrawn position for a sufficient period of time to allow the air flow, produced by the action of the vacuum source, to remove residual water so as to minimize the thermal requirements in the later drying operation.

This prior art process is sensitive to the performance characteristics of the vacuum source employed in the system. In order to understand this sensitivity, it is necessary to examine certain aspects of the process in greater detail.

During the formation of the batt, the accretion of an increasing thickness of fibres on the felting arbor results in a continuously increasing resistance to the flow of the slurry through the forming batt. It is possible to form a porous batt of a desired wall thickness with a reasonable time only if the vacuum source head capacity is sufficiently high to maintain a high slurry flow rate in spite of the increasing resistance. If, on the other hand, the vacuum source head capacity is insufficient, the ability to form a batt of the desired wall thickness within the required time period becomes impaired and, in the extreme case, it becomes impossible to form the required batt at all.

As the formed batt exits from the slurry, the action of the vacuum source continues to work upon it. At the surface of the slurry, an air/water interface is formed in the porous fibre structure at the outer surface of the batt. This interface exhibits a surface tension which prevents the entry of air into the porous structure and which must be overcome before dewatering of the batt can take place, i.e., a sufficient differential pressure must be exerted to cause rupture of the interface. If insufficient vacuum head is available, the batt will fail to dewater as it is withdrawn from the water and the wet batt will disintegrate as further withdrawal from the slurry takes place.

The teachings of prior art indicate that the vacuum source employed should provide a vacuum head capability falling in the range of 6 to 28 inches of mercury. Manufacturing experience has indicated that, for the normal thickness of batt required, and for the normal fibres employed, a vacuum source capable of the higher end of this range is required. In practice, this has necessitated the use of vacuum pumps in manufacturing systems. The vacuum head/flow characteristics of vacuum pumps are such that high vacuum heads are obtained at the expense of limited flow capability. This, in turn, has a limiting effect on the length of batt that can be successfully felted and dewatered. As the length of the felting arbor is increased, a point is reached where the vacuum pump flow capacity is exceeded after a certain length of the batt has been withdrawn from the slurry. This is due to ever increasing demand for flow capacity from the vacuum pump resulting from air flow through the dewatered upper sections of the batt. At this point, the vacuum head capacity of the vacuum pump drops off very rapidly, and the remainder of the batt fails to dewater for the reasons mentioned previously.

Prior to the present invention, manufacturers of this type of filter element were forced to limit the maximum length of such elements to approximately 14 inches. In most industrial applications, longer lengths are required and such elements must be used in end to end abutting relationship, in a stacked array, where longer lengths are required. It is difficult to obtain adequate seal between the abutting ends of the filter elements, and bypass of contaminants may occur.

Therefore, it has been found necessary to use vacuum pumps to provide the high vacuum head required to felt and dewater fibrous batts in the manufacture of resin bonded fibrous filter elements. For a given vacuum pump, there exists an outer limit to which a satisfactory batt length can be produced.

Therefore, the art has long sought a manner by which the shortcomings and defects in this respect could be overcome.

The main object of the present invention is to overcome these defects of the prior art.

A further object of the present invention is to manufacture a batt without length limitations.

Another object of the present invention is to employ vacuum source capacity in a manner enabling the formation of a batt and subsequent dewatering to take place under relatively constant operating conditions.

Still another object of the present invention is to increase overall efficiency in the manufacturing operation including a reduction in costs and time. The principal feature of the invention is directed to a method for progressively vacuum forming a fibre batt about a porous member whereby, accretion, consolidation and dewatering of said batt occur under constant vacuum conditions including the steps of: placing a porous felting arbor into a tank containing a slurry of fibrous material in water; disposing said felting arbor about a vacuum standpipe positioned within said tank, said standpipe being integrally formed with a fixed porous arbor at its uppermost portion; introducing a vacuum into said standpipe through a vacuum pump connected thereto; advancing said felting arbor out of said tank subsequent to the introduction of said vacuum; causing said fibrous material to be accreted on to said felting arbor by the action of said vacuum on said slurry through said felting arbor; sealing off a first portion of said fixed porous arbor with respect to said porous felting arbor for a preselected distance below the slurry level of said tank; sealing off a second portion of said fixed porous arbor with respect to said porous felting arbor at a prescribed distance above the slurry level; continuously introducing a vacuum through said fixed porous arbor to thereby define a fixed length vacuum zone between said sealed first and second portions for the progressive formation of said fibrous batt in said vacuum zone, and continuously advancing said felting arbor through said vacuum zone at a preselected constant rate of travel.

Additional objects and advantages of the invention will be more fully understood with reference to the specification, claims and accompanying drawings where:

In the drawings

FIG. 1*a* schematically illustrates the formation of a batt in an aqueous slurry as exemplified by the prior art.

FIG. 1*b* schematically illustrates batt withdrawal from the slurry and the start of dewatering and batt consolidation as exemplified by the prior art.

FIG. 1*c* schematically illustrates completion of the batt formation cycle and final dewatering as exemplified by the prior art.

FIG. 2 schematically illustrates in cross-section the formation of a batt employing the method of the present invention.

FIGS. 1*a*, 1*b*, 1*c* schematically illustrate the conventional prior art approach employed in the manufacture of a fibrous batt upon a porous arbor. In FIG. 1*a* the entire batt is formed within the aqueous fibre slurry by the action of a vacuum source on the arbor through a fixed standpipe (not shown). Next, according to FIG. 1*b*, the batt is withdrawn from the slurry, initial dewatering takes place and batt consolidation occurs. Lastly, in FIG. 1*c*, the cycle is completed, whereby final dewatering is carried out.

As shown in FIG. 2, the present method employs a tank 1 with a fibre slurry 2 deposited therein, having a fixed vertically extending suction pipe 3 positioned within the tank and a vacuum pump 4 connected to the pipe. A fixed porous member 5 is positioned at the upper end of the suction pipe 3. The member 5 is closed at the top end and provided with seals 6, 7 at the top and bottom. The zone defined by the two seals is total length over which the vacuum source operates.

Lastly, a vertically movable felting arbor 8 is disposed concentrically about and is removable from the suction pipe 3 and fixed porous member 5. A lift mechanism 9 is employed for vertically raising the porous felting arbor 8.

The seals 6, 7 of the fixed porous member 5 serve to provide a vacuum tight dynamic seal between the fixed porous member 5 and vertically moving porous felting arbor 8.

The tank 1 is provided with an adjustable overflow device 10 such as, an adjustable weir, for controlling the height of the fibrous slurry 2 and correspondingly the relationship of the slurry surface to the top and bottom seals 6, 7 that define the vacuum zone. In effect, that portion of the vacuum zone below the slurry surface represents the felting zone in which fibre accretion takes place and the zone above the slurry surface represents that portion of the vacuum zone where batt consolidation and dewatering takes place.

In actual operation, the porous felting arbor is mounted on to the lift mechanism 9 which in turn is caused to move downwardly into the tank 1 until the top of the porous felting arbor 8 is at some point below the slurry surface. At this time, the vacuum source is energized and felting is initiated. Simultaneously, the lift mechanism is caused to move upward at a selected constant speed bringing the felted section above the slurry surface into the dewatering zone. The subsequent dewatering operation is carried in manner described hereinbefore.

Felting and dewatering are continuous and progressive as the porous felting arbor is caused to move out of the slurry until a batt has been formed and dewatered over the full length of the arbor. Thereafter the arbor and batt are removed from the lifting mechanism and subsequently, the batt is dried, impregnated and finished by conventional means known to the art.

With this type of an arrangement, i.e., use of a fixed-felting and dewatering zone, it is possible to employ a vacuum source, such as a pump, that is smaller than that required to produce a similar length batt using prior art technology.

Although but a single embodiment of the invention has been illustrated and described in detail, it is to be expressly understood that the invention is not limited thereto. Various changes may be made in the process without departing from the spirit and scope of the invention as the same will now be understood by those skilled in the art.

What I claim:

1. A method for progressively vacuum forming a fibre batt about a porous member whereby, accretion, consolidation and dewatering of said batt occur under constant vacuum conditions including the steps of: placing a porous felting arbor into a tank containing a slurry of fibrous material in water; disposing said felting arbor about a vacuum standpipe positioned within said tank, said standpipe being integrally formed with a fixed porous arbor at its uppermost portion; introducing a vacuum into said standpipe through a vacuum pump connected thereto; advancing said felting arbor out of said tank subsequent to the introduction of said vacuum; causing said fibrous material to be accreted on to said felting arbor by the action of said vacuum on said slurry through said felting arbor; sealing off a first portion of said fixed porous arbor with respect to said porous felting arbor for a preselected distance below the slurry level of said tank; sealing off a second portion of said fixed porous arbor with respect to said porous felting arbor at a prescribed distance above the slurry level; continuously introducing a vacuum through said fixed porous arbor to thereby define a fixed length vacuum zone between said sealed first and second portions for the progressive formation of said fibrous batt in said vacuum zone, and continuously advancing said felting arbor through said vacuum zone at a preselected constant rate of travel.

* * * * *